US008505166B2

(12) United States Patent
Mitchell et al.

(10) Patent No.: US 8,505,166 B2
(45) **Date of Patent: *Aug. 13, 2013**

(54) HEAVY DUTY RISER HINGE

(75) Inventors: Brett A Mitchell, Newnan, GA (US); Thomas A Thorsen, Wedowee, AL (US)

(73) Assignee: Kason Industries, Inc., Newnan, GA (US)

( * ) Notice: Subject to any disclaimer, the term of this patent is extended or adjusted under 35 U.S.C. 154(b) by 4 days.

This patent is subject to a terminal disclaimer.

(21) Appl. No.: 13/234,577

(22) Filed: Sep. 16, 2011

(65) Prior Publication Data

US 2013/0067687 A1 Mar. 21, 2013

(51) Int. Cl.
*E05F 1/02* (2006.01)

(52) U.S. Cl.
USPC ..... 16/312; 16/315; 16/309

(58) Field of Classification Search
USPC ..... 16/303, 309, 310, 312, 316, 304, 16/306, 273, 342; 49/386, 239, 236–238; 312/326, 327, 321.5
See application file for complete search history.

(56) References Cited

U.S. PATENT DOCUMENTS 3,065,035 A * 11/1962 Biesecker ..... 384/296
3,451,124 A * 6/1969 Steiner et al. ..... 29/527.1
3,499,183 A * 3/1970 Parsons ..... 16/273
3,599,275 A * 8/1971 Granzow ..... 16/275
3,748,688 A * 7/1973 Berkowitz ..... 16/247
4,030,161 A * 6/1977 Loikitz ..... 16/284
4,573,239 A * 3/1986 Valenti et al. ..... 16/273
4,631,777 A * 12/1986 Takimoto ..... 16/315
4,675,940 A * 6/1987 Brockhaus ..... 16/273
5,463,795 A * 11/1995 Carlson et al. ..... 16/273
6,173,475 B1 * 1/2001 Senn et al. ..... 16/273
6,751,938 B1 * 6/2004 Llongueras ..... 57/90
7,945,996 B2 * 5/2011 Gunderson ..... 16/312

* cited by examiner

*Primary Examiner* — Chuck Y. Mah
(74) *Attorney, Agent, or Firm* — Baker Donelson; Dorian B. Kennedy

(57) ABSTRACT

A riser hinge (10) is disclosed which includes a mounting flange assembly (12) pivotally coupled to a strap assembly (15). The strap assembly includes a camming assembly (27) having a multi-lobed cam 28 with a large lobe (38) and a small lobe (39). The lobes have a top bearing surfaces which extends to a flat dwell surface. The large lobe top dwell surface (41) is of a select size (arcuate length) which is longer than that of the small lobe top dwell surface (44). The camming assembly also includes a cam follower (56) having two cam following ridges (69). The asymmetrical configuration of the grooves creates a first, large ridge (70) and a second, small ridge (71). The bottom bearing surface (77) of the small ridge rides upon the top bearing surface of the small lobe. Similarly, the bottom bearing surface (73) of the large ridge rides upon the top bearing surface of the large lobe.

9 Claims, 7 Drawing Sheets

HEAVY DUTY RISER HINGE

TECHNICAL FIELD

This invention relates to door hinges, and, more particularly, to riser hinges used on heavy doors such as on commercial refrigerators and the like.

BACKGROUND OF THE INVENTION

Heavy doors, such as those used on walk-in refrigerators, are often mounted to jambs by riser type hinges which lift the door when it is swung open, and which use gravity to assist in the closing of the door. These hinges have two barrels mounted one above the other. Each barrel has a mounting flange laterally extending therefrom. The flange of one barrel is secured to the door and the flange of the other barrel is secured to the jamb.

A riser hinge is a hinge which incorporates a means for raising the door as it is swung open. Typically this is in the form of a camming arrangement in which the barrel of the hinge mounted to the door rides up a camming surface as the door swings open, thereby lifting the door. This feature is desirable for several reasons. One reason for such is that as the door is swung open the clearance between the bottom of the door and the floor is increased, so that door operation is not hindered by small objects resting on the floor or floor variances in its path. The problem of floor clearance is important where the refrigerator floor and the adjoining floor are at the same level since to assure a good seal the door must fit tightly against the floor when fully closed, yet have ample clearance when being swung open. This lifting also prevents the wearing of a bottom gasket mounted to the door which seals the door when closed. Lastly, once the camming system has been actuated by opening the door, the door may be automatically closed upon being let go, with the weight of the door itself actuating the camming system in the reverse direction, if the camming system is not positioned at a resting or dwell position.

A problem long associated with this type of hinge when used on very heavy refrigerated room doors is that they typically do not lift the door fast enough to avoid irregularities in the floor. This problem is caused because the cam lifting configuration does not provide enough lifting force and is limited by the amount of bearing contact surface on the cam. If the bearing contact surface is insufficient the plastic cam material will cold flow resulting in damage and a short service life.

It thus is seen that a need remains for a heavy duty riser hinge which alleviates problems associated with those of the prior art. It is to the provision of such therefore that the present invention is primarily directed.

SUMMARY OF THE INVENTION

In a preferred form of the invention, a riser hinge for doors being suited from mating engagement with an associated cabinet or jamb comprises a mounting flange adapted to be mounted to a jamb, and a strap assembly adapted to be mounted to a door and pivotally coupled to the mounting flange. The strap assembly includes a strap, a cylinder portion coupled to the strap, and a camming assembly coupled to the cylinder portion. The camming assembly includes a cam having two asymmetrically positioned cam lobes, and a cam follower having two asymmetrically positioned cam following ridges configured to mate and ride upon the cam lobes. One cam lobe has a first dwell portion of a select length and the other cam lobe has a dwell portion of a select length larger than the select length of the first dwell portion.

DETAILED DESCRIPTION

Figure 1:
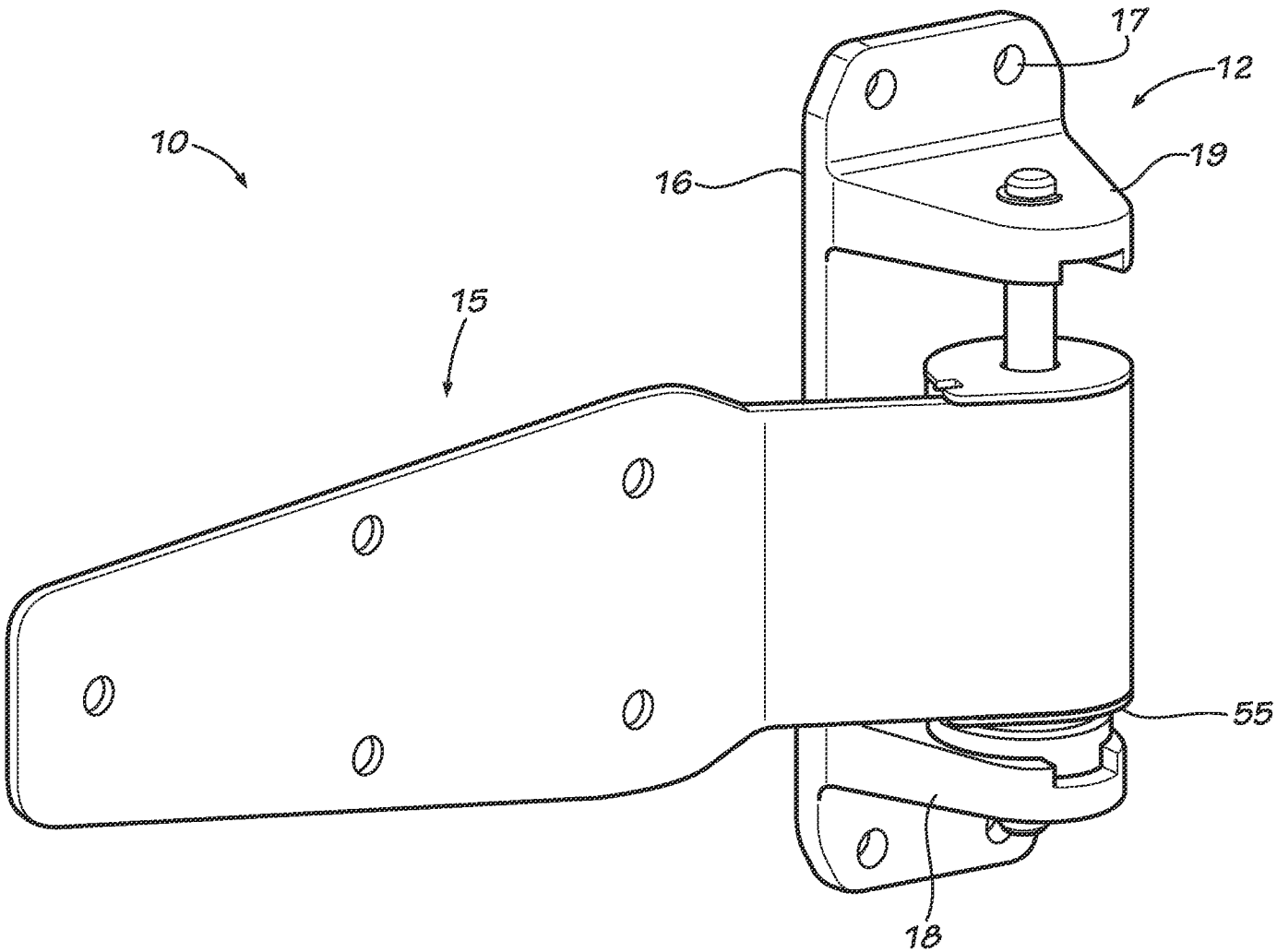
FIG. 1 is a perspective view of the riser hinge embodying principles of the invention in a preferred form, shown in a door closed position.

With reference next to the drawings, there is shown a riser hinge 10 according to the present invention. The hinge 10 includes a mounting flange assembly 12 pivotally coupled to a strap assembly 15. It is to be appreciated that the hinge 10 shown in the drawings is configured for use with a walk-in refrigerator or freezer door. The jamb and doors are well-known in the art and need not be disclosed further herein. It is to be further appreciated that the hinge 10, either alone or in combination with another hinge in accordance with the present invention, support a door (not shown) in the usual manner.

The mounting flange assembly 12 includes a mounting flange 16 having four mounting holes 17 therethrough adapted to receiving unshown mounting bolts or screws, a lower hinge arm 18 generally extending perpendicularly from the mounting flange 16, and an upper hinge arm 19 generally extending perpendicularly from the mounting flange 16. The upper hinge arm 19 has an inwardly tapered groove 20 extending from a bottom surface 21 and a rod mounting hole 22 extending therethrough. Similarly, the lower arm 18 has an inwardly tapered groove 24 extending from the top surface 25 and a rod mounting hole 26 extending there through.

The strap assembly 15 includes a camming assembly 27 having a multi-lobed cam 28 coupled to the lower hinge arm 18 which enables the hinge to be a riser type hinge. The cam 28 has a lower plate 29 and a cylindrical camming portion 30 extending upwardly from the lower plate 29 and having a top surface 31 opposite the lower plate 29. The lower plate 29 has two oppositely disposed guides or guide blocks 32 configured to removably mate with the tapered groove 24 extending from the lower hinge arm 18 to prevent relative rotation therebetween. The camming portion 30 and lower plate 29 have a central rod mounting hole 33 therethrough. The camming portion 30 is made entirely of a smooth, low-frictional, plastic material such as nylon.

The camming portion 30 also has a generally helical first groove or flight 35 therein extending from the top surface 31 and a generally helical second groove or flight 36 extending from the top surface 31. The first and second grooves 35 and 36 are positioned laterally offset from each other so that therebetween the camming portion is formed with a large lobe 38 and a small lobe 39. The large lobe 38 has an upwardly extending, helical top bearing surface 41 which extends to a generally flat, large top dwell surface or landing 42. The small lobe 39 has an upwardly extending, helical top bearing surface 43 which extends to a generally flat, small top dwell surface or landing 44. The large and small top dwell surfaces generally form top surface 31. The large lobe top dwell surface 41 is of a select size (arcuate length), while the small lobe top dwell surface 44 has with a select size (arcuate length) smaller than that of the large top dwell surface 42. The large top dwell surface 42 extends arcuately approximately 140 degrees about the center of the camming portion. The small lobe top dwell surface 44 extends arcuately approximately 60 degrees about the center of the camming portion. As such, the camming portion first groove 35 has a first top opening 45 with a spacing of approximately 80 degrees about the center and the second groove 36 has a second top opening 46 with a spacing of approximately 80 degrees about the center.

The strap assembly 15 also includes a strap 51 extending from a cylinder portion or barrel 52. The strap 51 includes four mounting holes 53. The term cylinder portion is meant to describe the enlarged casing located at the end of the strap. The term cylinder portion is not intended to be limited to a cylinder shape, as this portion or parts of this portion may be of many known shapes and are not necessarily cylindrical in shape. The cylindrical portion 52 includes an upper strap bearing 54 mounted partially within the cylindrical portion 52, and a lower strap bearing 55, in the form of a cam follower 56, mounted partially within the cylindrical portion 52. The cam follower 56 is a component of the camming assembly 27. The upper strap bearing 54 has a central rod mounting hole 58 therethrough. The lower strap bearing 55 has a central rod mounting hole 60 therethrough. A shoulder bolt or rod 61 extends through the upper hinge arm mounting rod hole 22, the upper strap bearing mounting hole 58, the lower strap bearing mounting hole 60, and through the lower hinge arm mounting rod hole 26. A locking c-ring 62 is mounted into a ring groove 63 on both the upper and lower ends of the rod 61 to maintain it in place.

The cam follower 56 has a lower plate 65 and a cylindrical cam following portion 66 defined by a cylindrical exterior wall 67 extending upwardly from the lower plate 65. The cam follower 56 is made entirely of smooth, low-frictional, plastic material such as nylon. The cylindrical cam following portion 66 has two asymmetrically positioned helical grooves 68 therein which form two asymmetrical cam following ridges 69. The asymmetrical configuration of the grooves 69 creates a first, large ridge 70 and a second, small ridge 71. The large ridge 70 has a large bottom bearing surface 73 having a helical rising portion 74 extending to a generally flat resting or dwell portion 75. The large bottom bearing surface 73 is configured to mate with the large lobe top bearing surface 41. The small ridge 71 has a small bottom bearing surface 77 having a helical rising portion 78 extending to a generally flat resting or dwell portion 79. The small bottom bearing surface 77 is configured to mate with the small lobe top bearing surface 43. The resting portions 75 and 79 each extend arcuately approximately 50 degrees about the center of the cylindrical portion 66. The large ridge 70 is sized and shaped to fit within the first groove 35 of the cam 28 while the small ridge 71 is sized and shaped to fit within the second groove 36 of the cam 28. As such, the bottom bearing surface 77 of the small ridge 71 rides upon or bears against the top bearing surface 43 of the small lobe 39. Similarly, the bottom bearing surface 73 of the large ridge 70 rides upon or bears against the top bearing surface 41 of the large lobe 38.

The strap cylinder portion 52 has a gap or space 82 adjacent the strap 51. The space 82 includes an enlarged portion 83 flanked by narrowed portions 84 at stop ledges 85. The upper strap bearing 54 and cam follower 56 each have a vertically oriented, elongated, locking flange 87 with a narrowed portion 88 extending to an enlarged portion or stop 89. The narrowed portion 88 is configured to fit within the narrowed portion 84 of the space 82, while the enlarged portion 89 is configured to removably fit within the enlarged portion 83 of the space 82. With this construction, the upper strap bearing 54 and cam follower 56 may be removed from the cylinder portion 52 by first horizontally and then vertically forcing the cam and cam follower enlarged portions 89 over the stop ledges 85 of the space 82 and into the narrowed portions 84 of the space, thereby releasing them and allowing them to be vertically removed and easily replaced in the event of excessive wear upon these components. The cam follower and upper strap may include screw holes to allow screws to be passed through thereby securing these components together.

In use, the hinge 10 is mounted to the refrigerator or freezer door in the conventional manner as is well known in the art. The mounting flange 16 is secured to the jamb by the use of screws (not shown) that extend through the mounting flange mounting holes 17 and into the jamb. A conventional walk-in refrigerator or freezer door is similarly secured to the hinge 10 by four screws (not shown) that extend through the four mounting holes 53 of the strap assembly.

Figure 2:
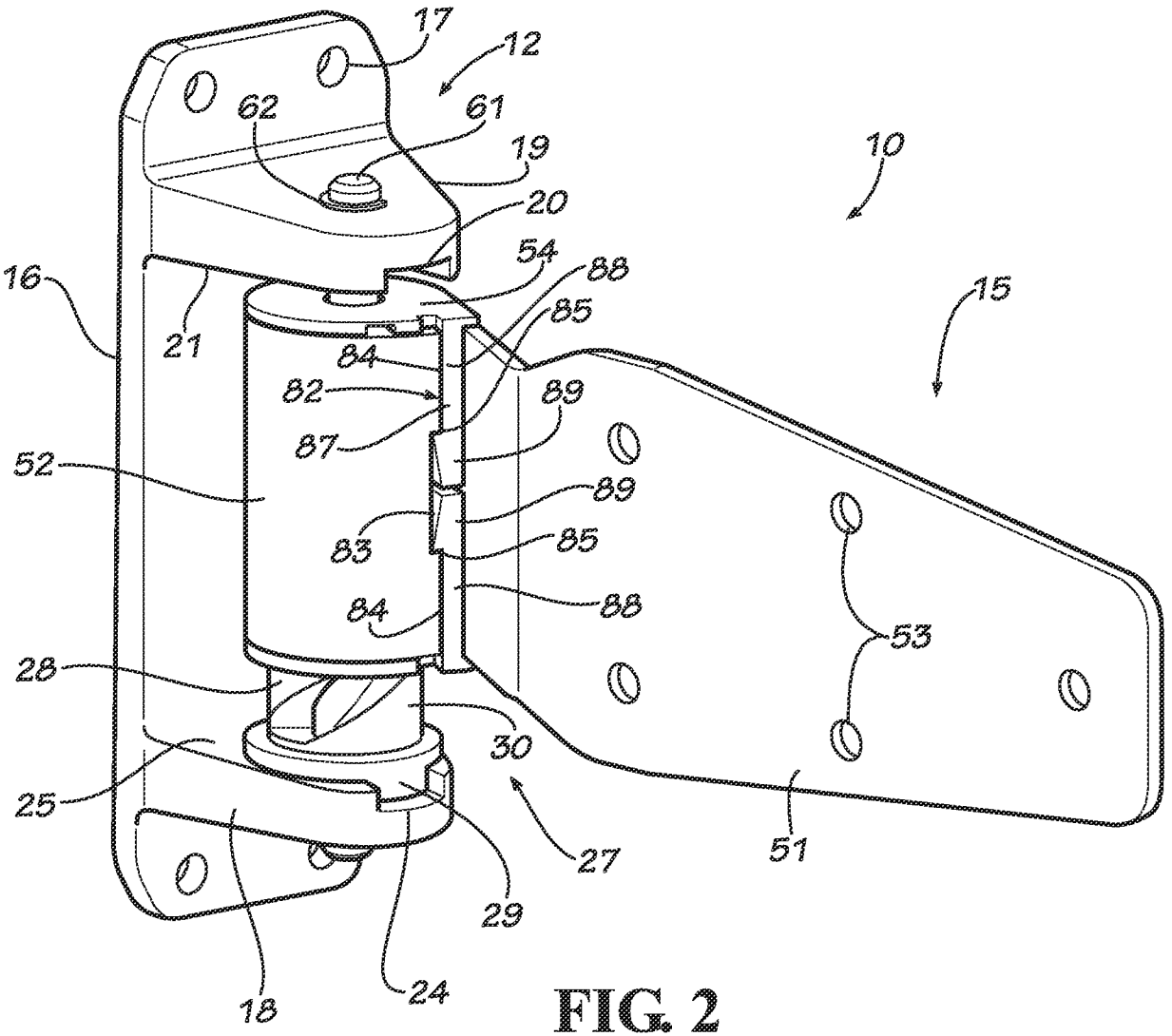
FIG. 2 is a perspective view of the riser hinge of FIG. 1, shown in a door half open position.
Figure 3:
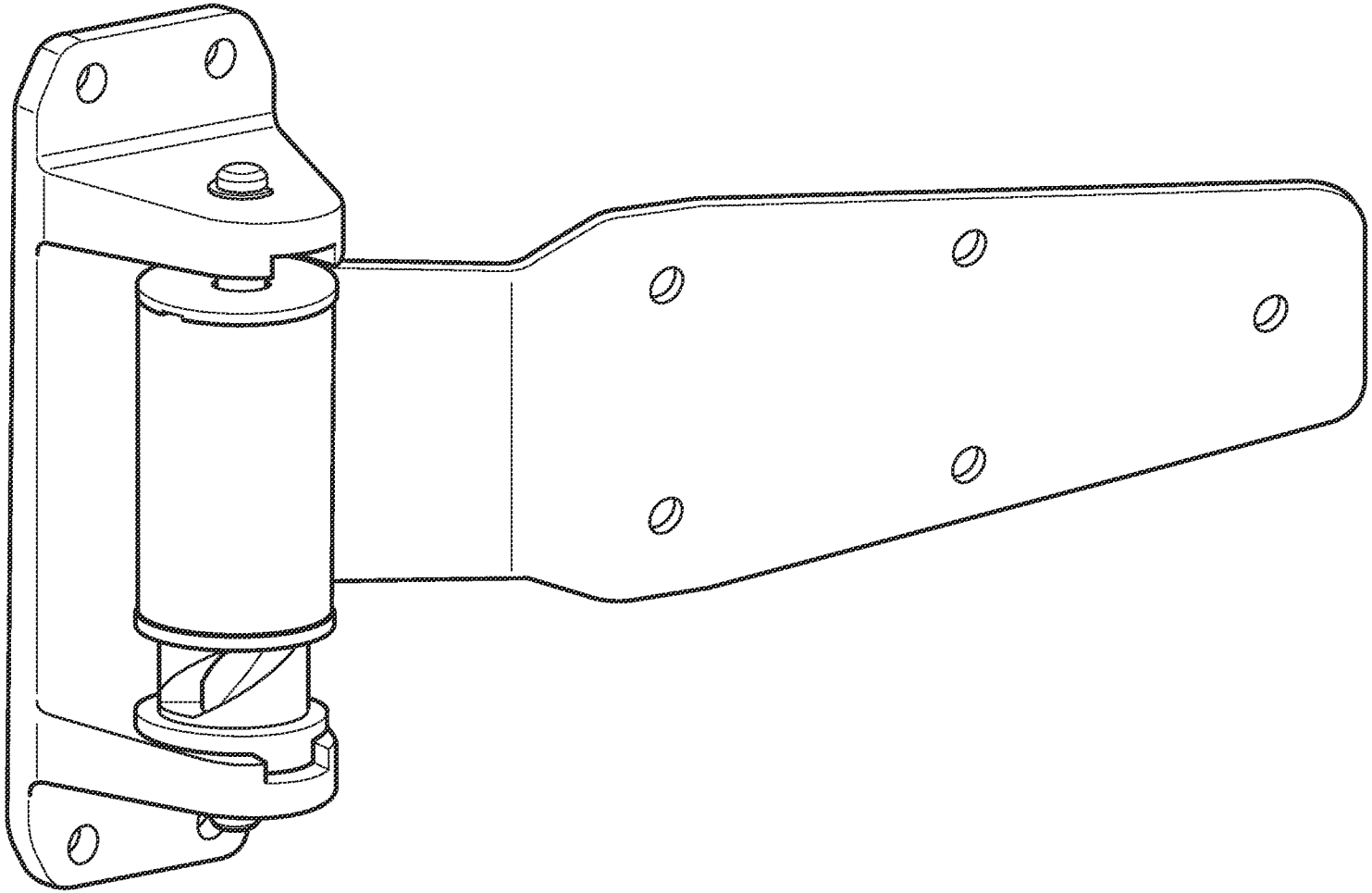
FIG. 3 is a perspective view of the riser hinge of FIG. 1, shown in a door open position.
Figure 4:
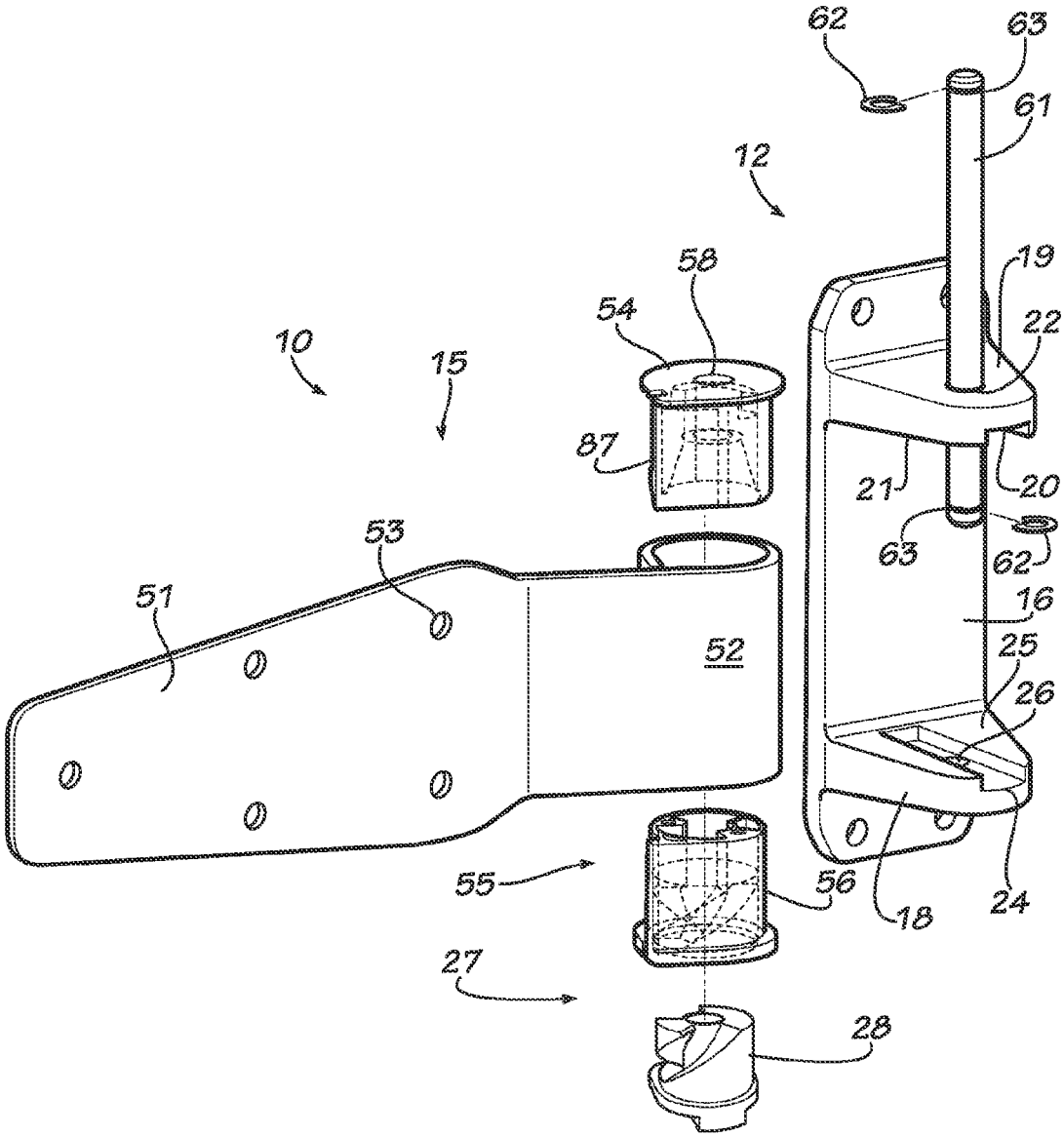
FIG. 4 is an exploded view of the riser hinge of FIG. 1.
Figure 5:
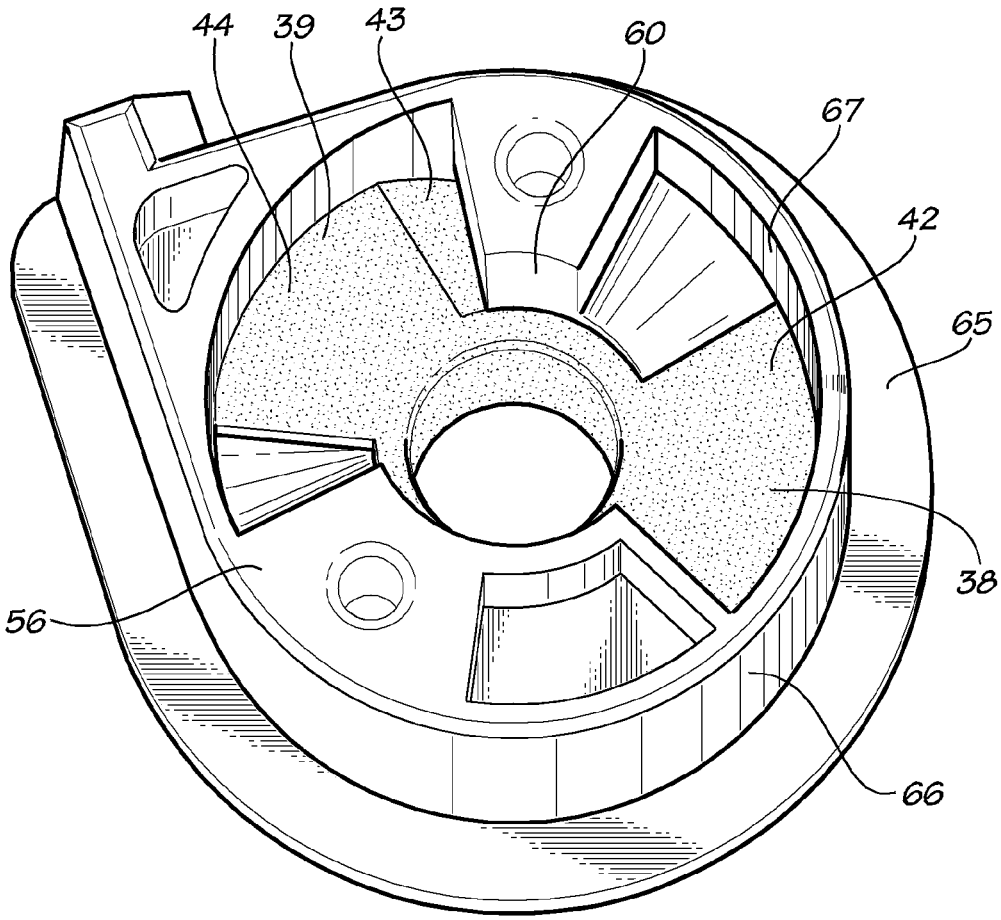
FIG. 5 is a top view of the cam and cam follower of the riser hinge of FIG. 1.
Figure 6:
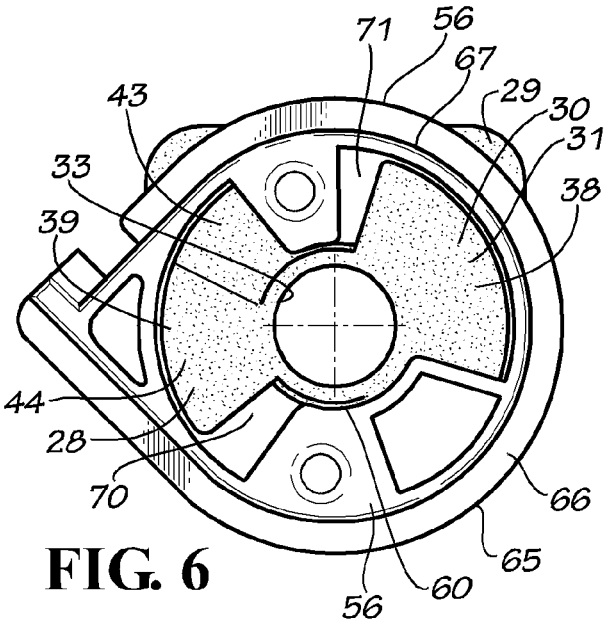
FIGS. 6-8 are a series of top views showing the cam and cam follower from a door closed position to a door open position.
Figure 7:
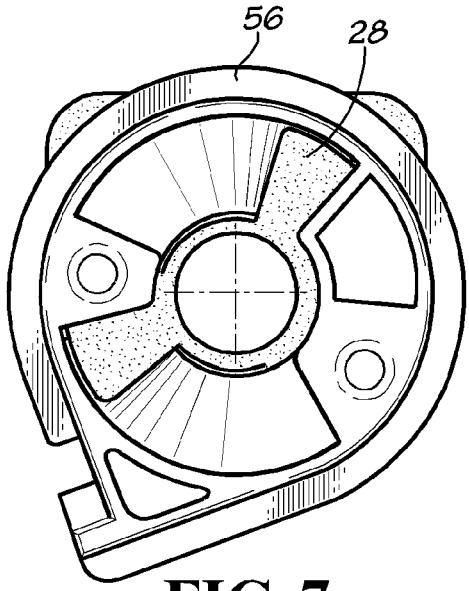
Figure 8:
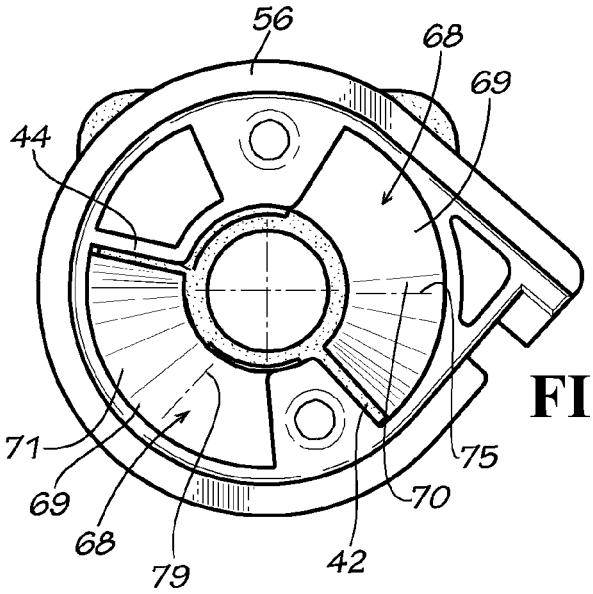
Figure 9:
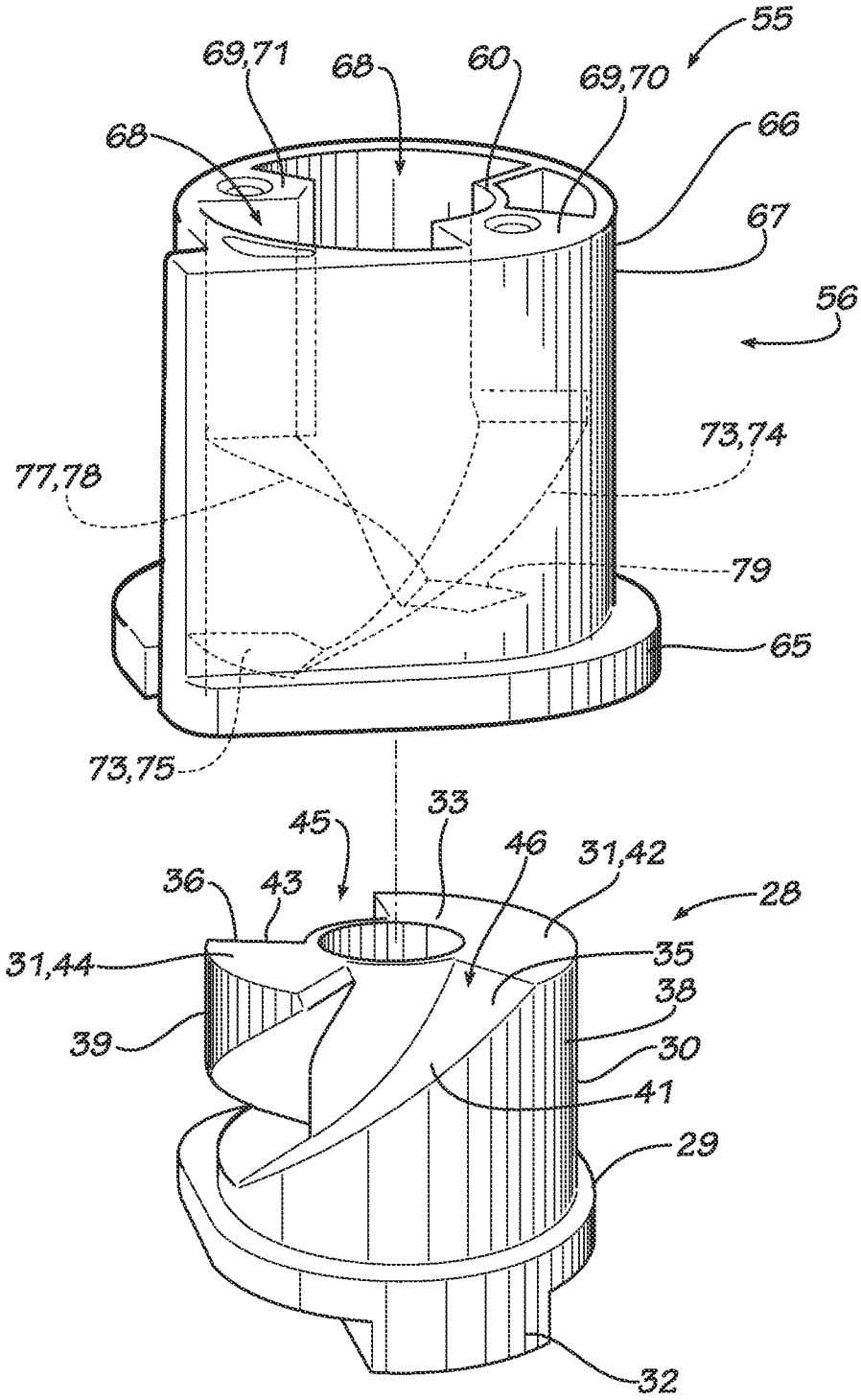
FIG. 9 is a perspective view of the cam and cam follower of the riser hinge of FIG. 1.

As the door is swung open, from a door closed position shown in FIGS. 1 and 6, the cam follower 56 rotates about the hinge rod 61 and upon the underlying cam 28. As this occurs, the helical cam follower large ridge 70 and small ridge 71 ride upwardly upon the cam large lobe 38 and small lobe 39, respectively, as shown in FIGS. 2 and 7. The cam follower 56 rotates in this manner until the cam follower rising portions 74 and 78 crest the cam lobe top bearing surfaces 41 and 43 and the cam follower flat resting portions 75 and 79 ride onto the cam top dwell surfaces 42 and 44. The initial movement of the cam follower causes it to rise relative to the cam, and thus the door rises relative to the structure to which it is mounted and underlying floor. Once the cam follower flat resting portions 75 and 79 ride onto the cam top dwell surfaces 42 and 44 the lifting of the door ceases and the door simply continues to rotate open without any vertical movement, as shown in FIGS. 3 and 8. Thus, if the door is now released it will tend to remain stationary. Conversely, should the door be released before this occurs, the weight of the door will cause the camming to close the door as the cam follower rides down the cam and is returned to its at rest, closed position.

It should be understood that if the cam grooves and resulting lobes were symmetrical the over rotation of the door opening movement would cause the ridges 70, 71 to fall into the opposite grooves 35, 36 causing a disastrous situation. Also, the door would not be capable of moving much further past its dwell point due to the limited amount of dwell contact surface between the cam top dwell surfaces and cam follower flat resting portions. However, by creating an asymmetrical arrangement of the cam grooves 35 and 36 and large and small lobes 38 and 39, and the asymmetrical arrangement of the cam follower grooves 68 and large and small ridges 70 and 71 this situation does not occur. As the cam follower is rotated past the initial dwell point the ridges' flat resting portions 75 and 79 ride upon the lobe top dwell surfaces 42 and 44, wherein the extended length (large arcuate length) of the large lobe top dwell surface 41 allows extended contact and thus rotation. Additionally, this insures that contact always exists between the lobes and the ridges as they are laterally offset from each other, as the cam large lobe top dwell surface 42 is larger than the opposite groove opening between the cam follower ridges flat resting portions 75 and 79, i.e., the cam large lobe top dwell spans or bridges the space of the opposite groove and the large ridge flat resting portion remains on the large lobe top dwell surface even when the small ridge flat resting portion extends over the first groove top opening 45.

It should also be understood that the upper hinge arm 19 also includes a tapered groove 20 even though such is not utilized in the drawings. However, should an installer wish to install the hinge as a left hand hinge, as opposed to the right hand hinge arrangement shown in the drawings, the installer simply inverts the mounting flange 16 so that the upper hinge arm 19 becomes a lower hinge arm 18, the upper strap bearing 54 and lower strap bearing 55 are removed and replaced with oppositely oriented bearings within the strap cylindrical portion 52.

It should be understood that the positioning, configuration, or orientation of the cam and cam follower may be reversed, as such, the terms cam and cam follower may be used interchangeably.

It thus is seen that a riser hinge is now provided which overcomes problems long associated with those of the prior art. It should, however, be understood that the just described embodiments merely illustrate principles of the invention in two preferred forms. Many modifications, additions and deletions may, of course, be made thereto without departure from the spirit and scope of the invention as set forth in the following claims.

The invention claimed is:

1. A riser hinge for doors being suited from mating engagement with an associated cabinet or jamb, the riser hinge comprising:

a mounting flange adapted to be mounted to a jamb, and a strap assembly adapted to be mounted to a door and pivotally coupled to said mounting flange, said strap assembly including a strap, a cylinder portion coupled to said strap, and a camming assembly coupled to said cylinder portion, said camming assembly includes a cam fixedly positioned to said mounting flange and having two asymmetrically positioned cam lobes, and a cam follower coupled to said cam for rotatable movement therebetween and having two asymmetrically positioned cam following ridges configured to mate and ride upon said cam lobes, one said cam lobe having a first dwell portion of a select length and said other cam lobe having a dwell portion of a select length larger than said select length of said first dwell portion.

2. The riser hinge of claim 1 wherein said mounting flange has an upper hinge arm and a lower hinge arm, and wherein said lower hinge arm includes a mounting groove and wherein said cam includes a guide configured to be received within said lower hinge arm mounting groove.

3. A riser hinge for doors being suited from mating engagement with an associated cabinet or jamb, the riser hinge comprising:

a mounting flange adapted to be mounted to a jamb having a lower arm and an upper arm, and a strap assembly adapted to be mounted to a door and pivotally coupled to said mounting flange, said strap assembly including a strap, a barrel coupled to said strap, and a camming assembly coupled to said barrel, said camming assembly includes a cam fixedly positioned to said mounting flange and a cam follower configured to mate with said cam for rotational movement therebetween, said cam having a first cam lobe having a first top bearing surface extending to a first top dwell surface of a first selected length, said cam also having a second cam lobe having a second top bearing surface extending to a second top dwell surface of a second selected length, said first top dwell surface first selected length being larger than said second top dwell surface second selected length, said cam follower having a first cam following ridge having a first bottom bearing surface configured to mate with said cam first cam lobe first top bearing surface and a first bottom resting surface configured to mate with said cam first cam lobe first top dwell surface, said cam follower having a second cam following ridge having a second bottom bearing surface configured to mate with said cam second cam lobe second top bearing surface and a second bottom resting surface configured to mate with said cam second cam lobe second top dwell surface.

4. The riser hinge of claim 3 wherein when said cam follower second cam following ridge second bottom resting surface is not positioned upon said second cam lobe second top bearing surface said first cam following ridge first bottom resting surface is positioned upon said first cam lobe first top bearing surface.

5. The riser hinge of claim 3 wherein said lower hinge arm includes a mounting groove and wherein said cam includes a guide configured to be received within said lower hinge arm mounting groove.

6. The riser hinge of claim 3 wherein said first top bearing surface and said second top bearing surface are helical, and wherein said first bottom bearing surface and said second bottom bearing surface are helical.

7. A riser hinge for doors being suited from mating engagement with an associated cabinet or jamb, the riser hinge comprising:

a mounting flange adapted to be mounted to a jamb, and a strap assembly adapted to be mounted to a door and pivotally coupled to said mounting flange, said strap assembly including a strap and a camming assembly coupled to said strap, said camming assembly includes a cam fixedly positioned to said mounting flange and having a top surface, a first helical groove extending from said top surface defining a first top bearing surface, a second helical groove extending from said top surface defining a second top bearing surface, said first and second grooves dividing said top surface so as to define a first dwell surface extending from said first top bearing surface and a second dwell surface extending from said second top bearing surface, said first and second grooves being laterally offset from each other so that said first dwell surface is longer than said second dwell surface, said camming assembly also including a cam follower coupled to said cam for rotatable movement therebetween and having a first following ridge configured to be received within and rotated relative to said cam first groove and upon said first dwell surface, and a second following ridge configured to be received within and rotated relative to said cam second groove and upon said second dwell surface, whereby rotation of the cam relative to the cam follower causes the cam follower ridges to ride upon the cam first and second top bearing surfaces and upon the cam first and second dwell surfaces.

8. The riser hinge of claim 7 wherein said mounting flange includes a lower hinge arm which has a mounting groove and wherein said cam includes a guide configured to be received within said lower hinge arm mounting groove.

9. The riser hinge of claim 7 wherein said first top bearing surface and said second top bearing surface are helical, and wherein said first following ridge and said second following ridge are helical.

* * * * *